US010667972B2

(12) United States Patent
Fich

(10) Patent No.: US 10,667,972 B2
(45) Date of Patent: Jun. 2, 2020

(54) BED

(71) Applicant: IDEAssociates (IOM) Limited, Douglas, Isle of Man (GB)

(72) Inventor: Preben Bo Fich, Donnybrook (IE)

(73) Assignee: IDEASSOCIATES (IOM) LIMITED, Douglas, Isle of Man (GB)

( * ) Notice: Subject to any disclaimer, the term of this patent is extended or adjusted under 35 U.S.C. 154(b) by 741 days.

(21) Appl. No.: 15/032,889

(22) PCT Filed: Nov. 6, 2013

(86) PCT No.: PCT/IB2013/002454
§ 371 (c)(1),
(2) Date: Apr. 28, 2016

(87) PCT Pub. No.: WO2015/067979
PCT Pub. Date: May 14, 2015

(65) Prior Publication Data
US 2016/0250087 A1 Sep. 1, 2016

(51) Int. Cl.
*A61G 7/012* (2006.01)
*A61G 7/008* (2006.01)
(Continued)

(52) U.S. Cl.
CPC ..... *A61G 7/012* (2013.01); *A47C 19/122* (2013.01); *A61G 1/02* (2013.01); *A61G 7/005* (2013.01);
(Continued)

(58) Field of Classification Search
CPC ..... A61G 1/02; A61G 1/0293; A61G 7/005; A61G 7/008; A61G 7/012; A61G 7/015;
(Continued)

(56) References Cited

U.S. PATENT DOCUMENTS 6,076,210 A * 6/2000 Wu ..... A47C 19/122 5/174
8,935,817 B2 * 1/2015 Suh ..... A47C 19/122 5/174
(Continued)

FOREIGN PATENT DOCUMENTS

DE 44 16 690 5/1994
EP 1 286 909 4/2005
(Continued)

OTHER PUBLICATIONS

Dictionary.com, definition of "beam", 2019 (Year: 2019).*
International Search Report dated Jul. 1, 2014 for PCT/IB2013/002454.

*Primary Examiner* — Nicholas F Polito
(74) *Attorney, Agent, or Firm* — The Law Offices of Eric W. Peterson

(57) ABSTRACT

A bed (1) comprising, a base part, with a patient support base (10) arranged above the base part, and including a position configurable patient support (19), four telescopic elevator columns (5), mounted on said base part. The four elevator columns (5) are arranged as a first and a second pair of telescopic elevator columns (5). The bed (1) has two cross-beams (8) for supporting the patient support base (10). An operator housing (9) is mounted on at least one of said cross-beams (8). The operator housing (9) comprises means for configuring said position configurable patient support (19). The operation housing (9) and said patient support base (10) comprising mutually releasable connection means.

6 Claims, 9 Drawing Sheets

Figure 1:
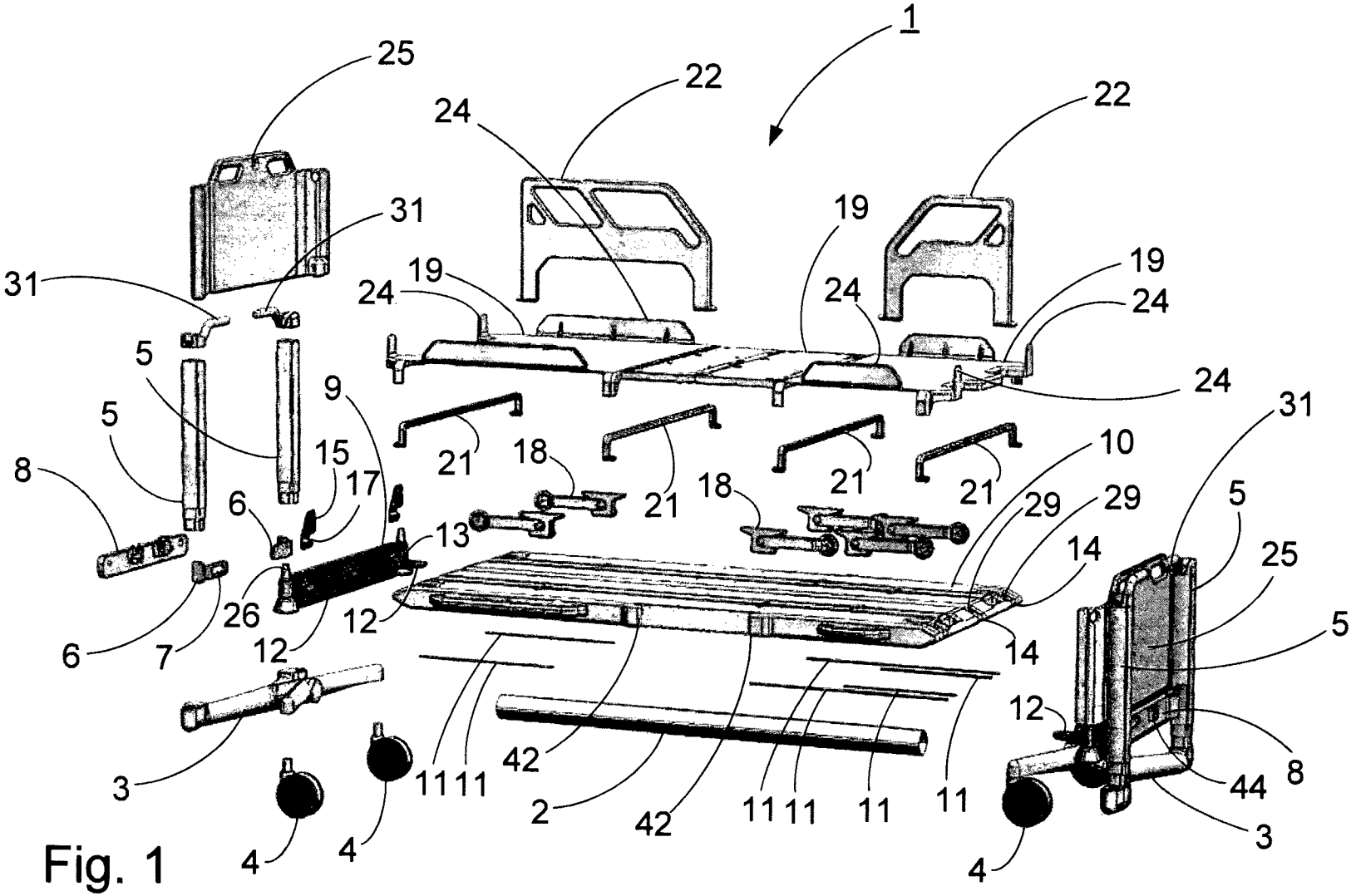
Figure 2:
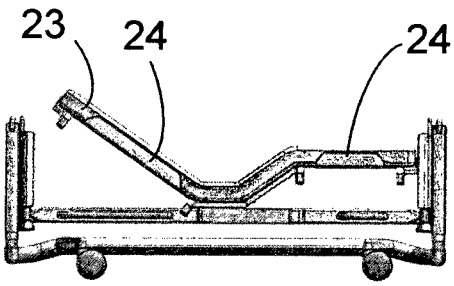

(51) Int. Cl.

| | |
|---|---|
| ***A61G 7/015*** | (2006.01) |
| ***A61G 7/018*** | (2006.01) |
| ***A61G 7/005*** | (2006.01) |
| ***A47C 19/12*** | (2006.01) |
| ***A61G 1/02*** | (2006.01) |

(52) U.S. Cl.
CPC ..... *A61G 7/008* (2013.01); *A61G 7/015* (2013.01); *A61G 7/018* (2013.01); *A61G 1/0293* (2013.01); *A61G 2203/76* (2013.01); *A61G 2203/78* (2013.01)

(58) Field of Classification Search
CPC ..... A61G 7/018; A61G 13/04; A61G 13/06; A61G 13/08; A47C 19/045; A47C 19/122; A47C 20/041; A47C 20/10
See application file for complete search history.

(56) References Cited

U.S. PATENT DOCUMENTS

2002/0144350 A1* 10/2002 Shih ..... A47C 20/041 5/620
2007/0192960 A1* 8/2007 Jackson ..... A61G 7/001 5/618
2008/0000028 A1* 1/2008 Lemire ..... A61G 7/001 5/618
2008/0189856 A1* 8/2008 Toms ..... A47C 19/045 5/424
2011/0010858 A1 1/2011 Tesar et al.
2011/0030142 A1* 2/2011 Karwal ..... A61G 7/005 5/608
2011/0099716 A1* 5/2011 Jackson ..... A61G 13/0036 5/607
2014/0237723 A1* 8/2014 Wysocki ..... A61G 7/015 5/613

FOREIGN PATENT DOCUMENTS

| | | |
|---|---|---|
| EP | 1 404 980 | 2/2006 |
| EP | 1 929 623 | 1/2011 |
| FR | 2 769 497 | 10/1997 |
| JP | 60-98465 | 12/1983 |
| WO | 2007/067874 | 6/2007 |
| WO | 2008/003027 | 1/2008 |
| WO | 2014056502 A1 | 4/2014 |

* cited by examiner

BED

The present application claims benefit of International Patent Application No. PCT/IB2013/002454, filed on Nov. 6, 2013 and entitled "A Bed", the contents of which are incorporated herein by reference in its entirety.

The present invention relates to a bed, in particular but not exclusively, a bed for a person needing special care, such as a hospital bed, and more specifically to a bed comprising a base part, with a patient support base arranged above the base part, and including a position configurable patient support, four telescopic elevator columns, mounted on said base part, said four elevator columns being arranged as a first and a second pair of telescopic elevator columns, and two cross-beams for supporting the patient support base, wherein an operator housing is mounted on at least one of said cross-beams, said operator housing comprising means for configuring said position configurable patient support, said operation housing and said patient support base comprising mutually releasable connection means.

Beds for people needing special care are subject to a large number of functional requirements. Apart from properly facilitating the care of the user, in the following referred to as the patient, the handling of the bed itself in a care environment such as a hospital or a retirement home, and the ergonomics of all care personnel, such as nurses, porters or doctors, must be considered.

The resting surface of the bed must allow for different configurations in order to position the patient in different positions, e.g. seated, lying down, elevated feet, etc. for sleep, rest and/or in-bed treatment. Also, it should be possible to lower or raise the resting surface, e.g. for allowing the patient to be able to get in or out of bed, or for providing good ergonomic working positions for care personnel when treating or handling the patient. In getting in and out of bed it may, moreover, be helpful for the patient and assisting care personnel, if the resting surface may be inclined sideways, i.e. lowered on one or the other side of the bed, e.g. for washing, turning or treating the patient, or for changing the resting position of the patient to avoid bed sores or the like. In view of the ergonomics of care personnel mentioned above there is a need to motorize as many and preferably all of the above functionalities.

The bed must also be movable, e.g. allowing the patient to be transported therein, but also for the bed to be moved to a cleaning facility and/or a storing location when not in use. During storage, the bed should take up as little storage space as possible. The bed should be rugged so as not be damaged during such transportation and storage, where bumps and impacts are likely to occur. Also, the bed should be rugged enough to withstand aggressive cleaning agents, disinfectants, the high pressure and temperature of an autoclave etc. during cleaning.

In view of the transport of the patient mentioned above it has in WO-A-2007/067874 been proposed to provide a bed comprising a single surface system, i.e. a bed with a patient support part that allows for accommodation, diagnosis, treatment and transfer of the patient. This bed however, does generally not lend itself to motorization of the functionalities in terms of configuration, inclination, etc. Also, it does not allow lowering or raising of the patient support as much as could be desired when the patient has to get in and out of the bed. Moreover some people have a tendency to fall out of bed, and in that case lowering the bed so low that the risk of harm to the patient is reduced.

Based on this prior art it is the object of the present invention to provide a bed which is versatile in terms of patient accommodation, diagnosis, treatment and transfer, motorized for configuration, inclination, tilt, and lift, takes up little space is easily cleaned, and is rugged.

According to a first aspect of the present invention this object is achieved by a bed comprising a base part with a patient support base arranged above the base part, and including a position configurable patient support, four telescopic elevator columns mounted on said base part, said four elevator columns being arranged as a first and a second pair of telescopic elevator columns, and two cross-beams for supporting the patient support base, wherein an operator housing is mounted on at least one of said cross-beams said operator housing comprising means for configuring said position configurable patient support, said operation housing and said patient support base comprising mutually releasable connection means.

By using four telescopic elevator columns it becomes possible to adjust the patient support about two axes, i.e. the tilt about the longitudinal axis and inclination about the axis across the bed, by simply controlling the individual columns appropriately, thereby raising, lowering and tilting the cross-beams between the columns of each pair of columns at either end of the bed. At the same time, mounting the operator housing on the cross-beam allows all the controls for the configuration of the resting surface to be located together and well protected, but still in close proximity of the patient support. Furthermore, having the operator housing arranged in a releasable manner on the cross-beam allows the operator housing with the patient support to be swung to a vertical position, allowing the bed, including the bed frame, to be ganged with other beds in order to save space during storage, cleaning, disinfection, autoclaving and the like. Ideally the two elevator columns of a respective pair are close together in order to maximize the space saving, but there are other factors involved. Inter alia access to the patient's head and upper body is indispensable in cases of cardiac arrest, meaning that sufficient space for this must be provided between the two elevator columns 5 of a pair of elevator columns. As an overall rule, however, sum of the thickness of the two elevator columns 5 and the space between them is narrower together than the width of the patient support base 10. More specifically the thickness of the two outer tubular members 5*a* and the spacing between them totals less than the width of the patient support base 10.

According to a preferred embodiment, an operator housing is connected to each of said cross-beams, and both of said operator housings are arranged between the first pair of telescopic elevator columns and the second pair of telescopic elevator columns. This allows for having an operator housing at either end of the bed, and short distances for mechanical transmission from the operator housing to the configurable parts of the configurable patient support.

According to a further preferred embodiment, pivotal means are provided for allowing pivotal movement of the operator housing with respect to said cross-beams. This allows the patient support to simply be swung into the vertical position upon release of the mutually releasable connection means.

According to another preferred embodiment, each telescopic elevator column comprises an elongate outer tubular member, said outer tubular member having an open first end, and an elongate inner member arranged so as to perform a sliding movement through said open first end from a retracted position, at least partially within said outer elongate tubular member, to an extended position at least partially outside said outer elongate tubular member, said elongate inner member being supported at a first end by said base part. This allows the patient support to be lowered to a very low elevation, in turn, reducing the risk of the patient being harmed, should he fall out of bed.

According to yet another preferred embodiment, each of the four telescopic elevator columns is individually controllable. This allows a high degree of flexibility in the control of the columns, which in turn allows the patient support to incline and tilt according to predetermined or even randomized patterns, e.g. under computer control. Continuously moving the patient support in this manner may prevent bed sores, liquid in the lungs and other known problems for bedridden persons.

Figure 4:
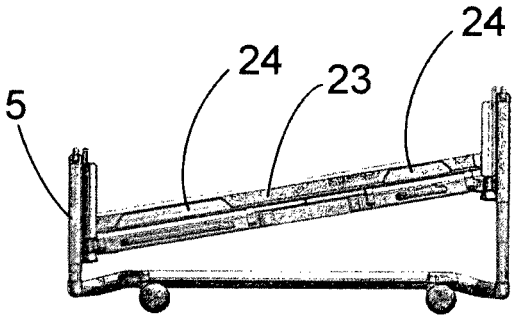
Figure 5:
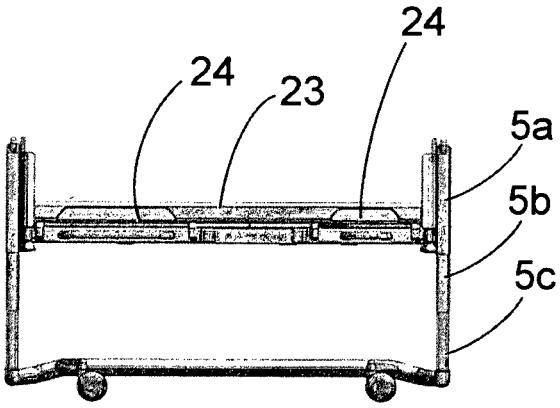
Figure 6:
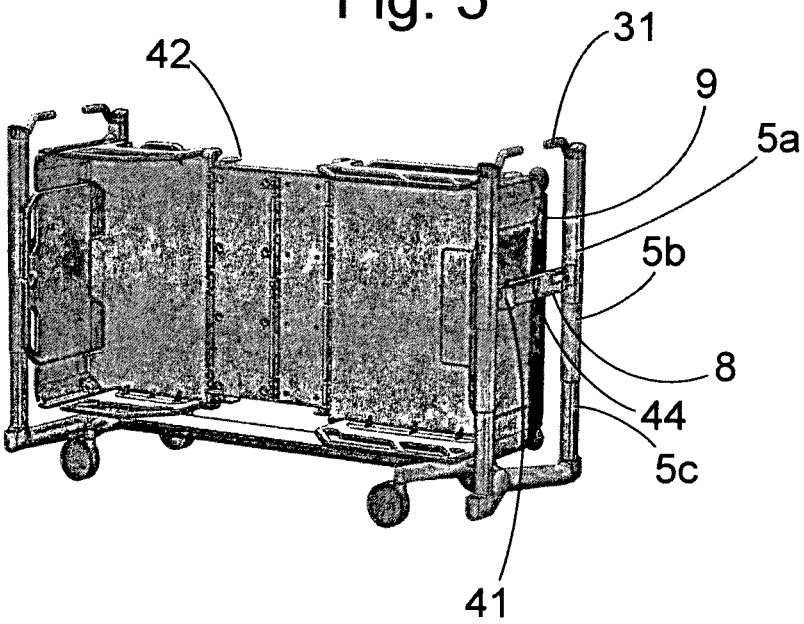
Figure 7:
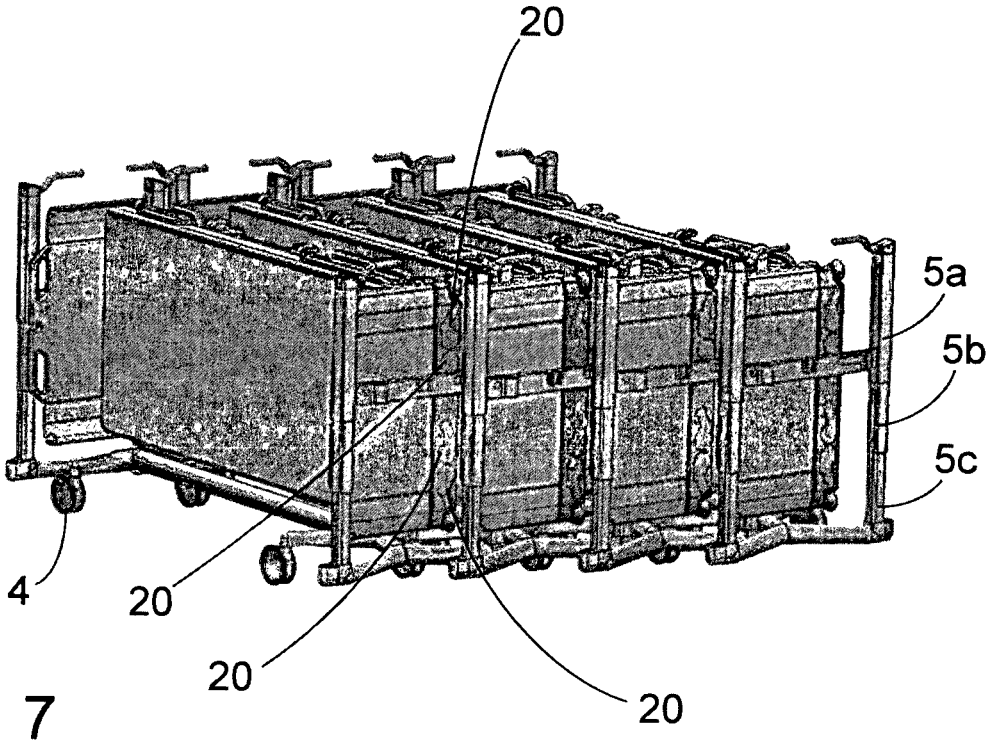
Figure 8:
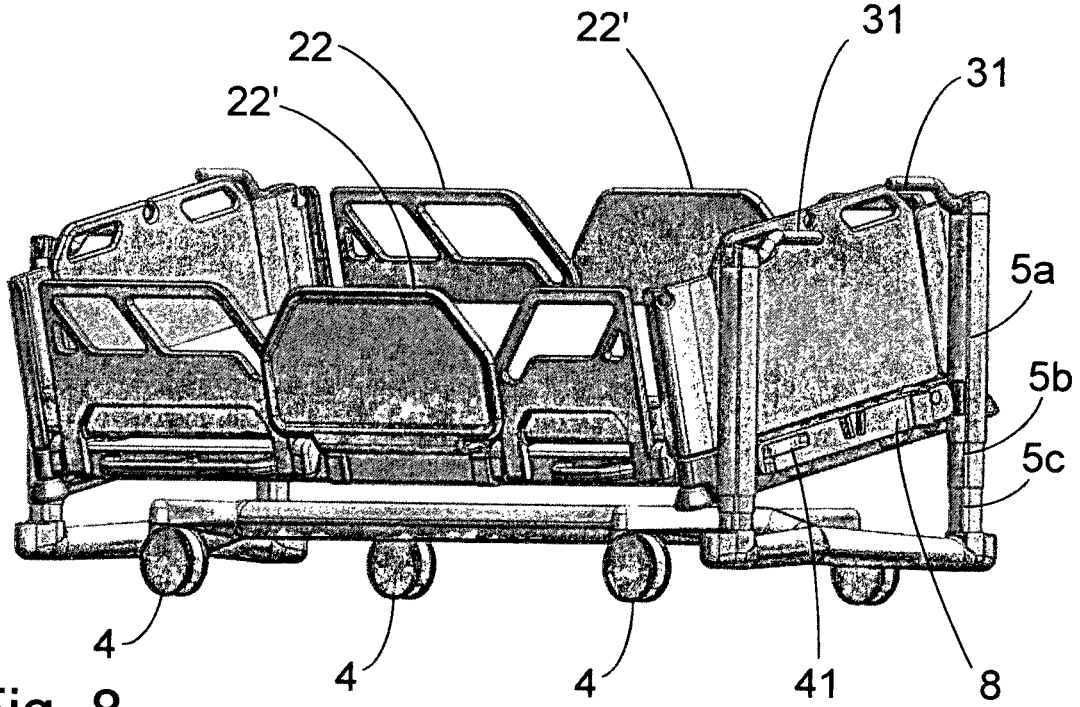
Figure 9A:
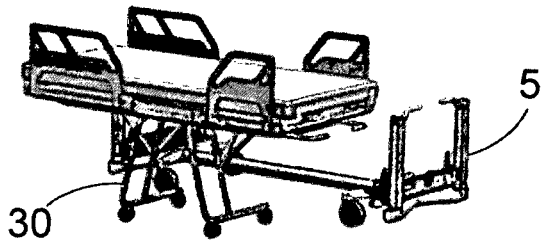
Figure 9B:
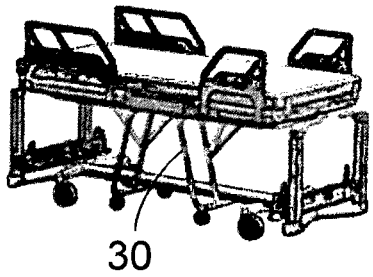
Figure 9C:
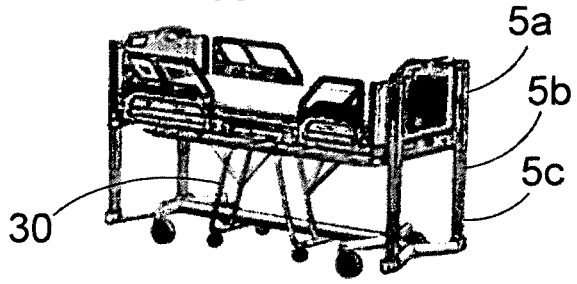
Figure 9D:
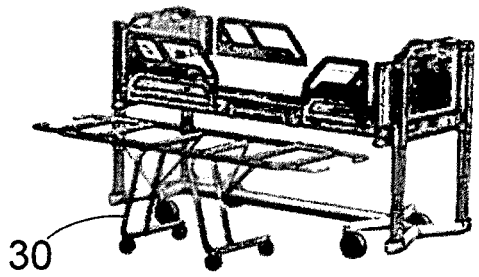
Figure 9E:
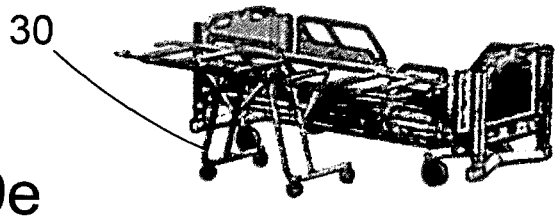
Figure 9F:
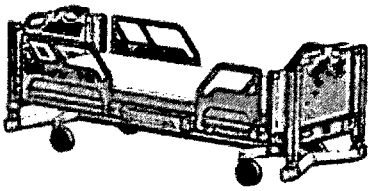
Figure 10:
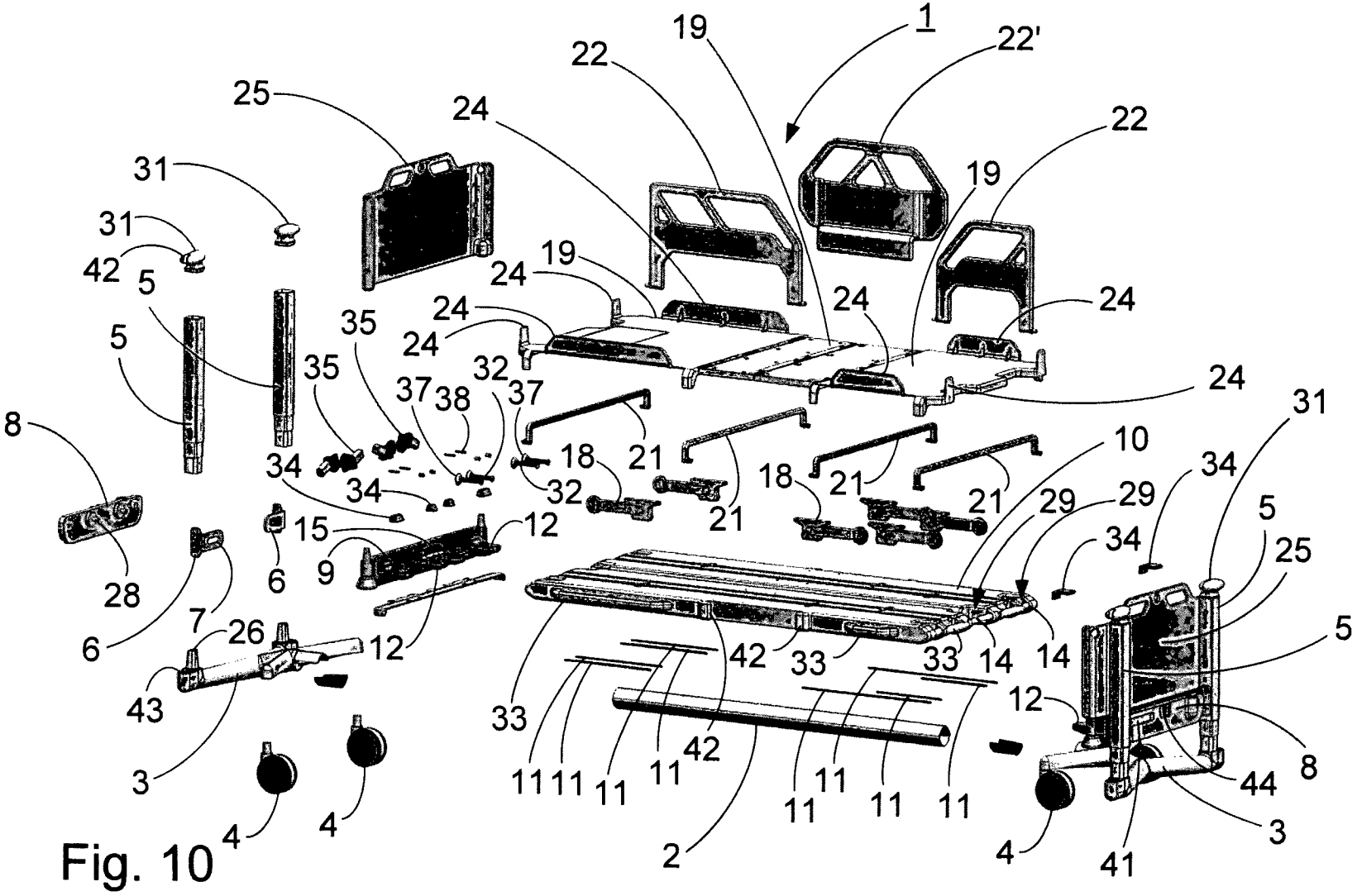
Figure 11:
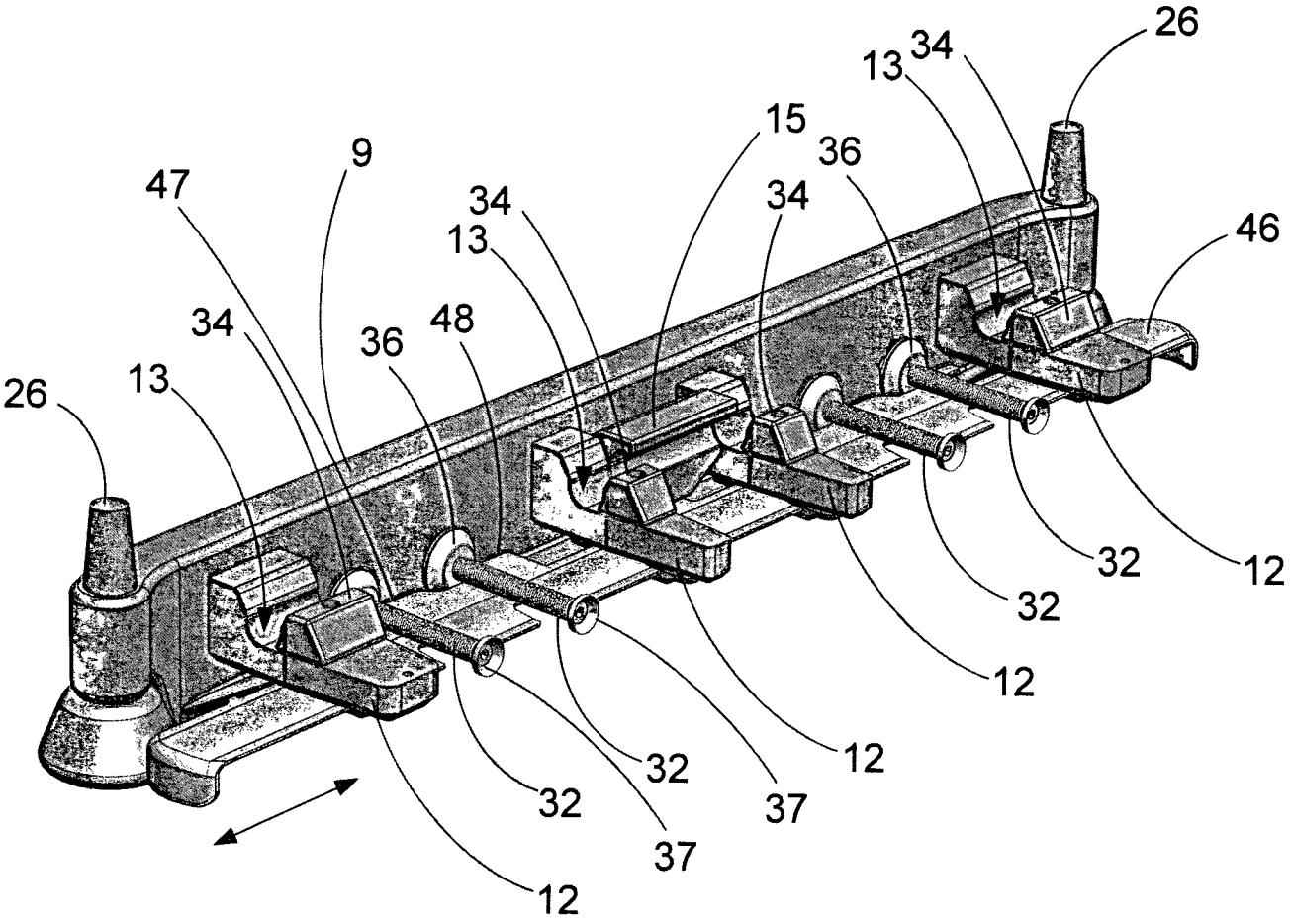
Figure 12B:
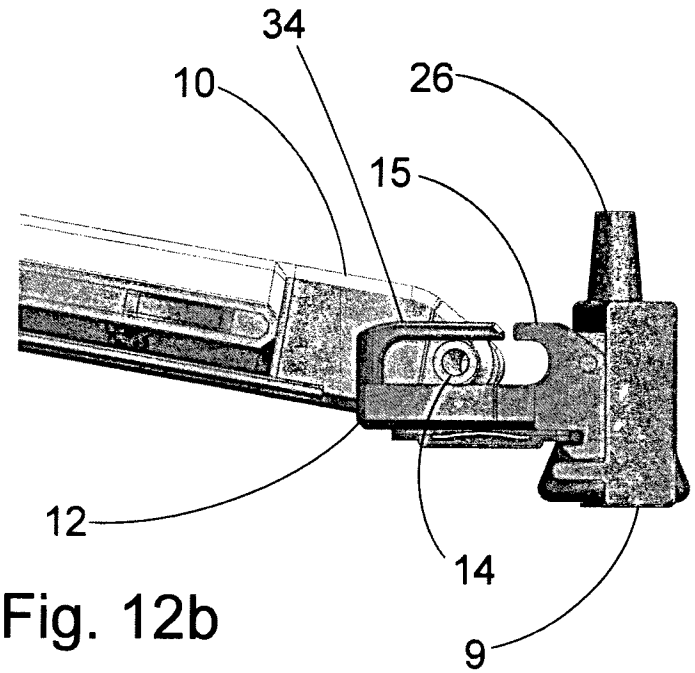
Figure 12A:
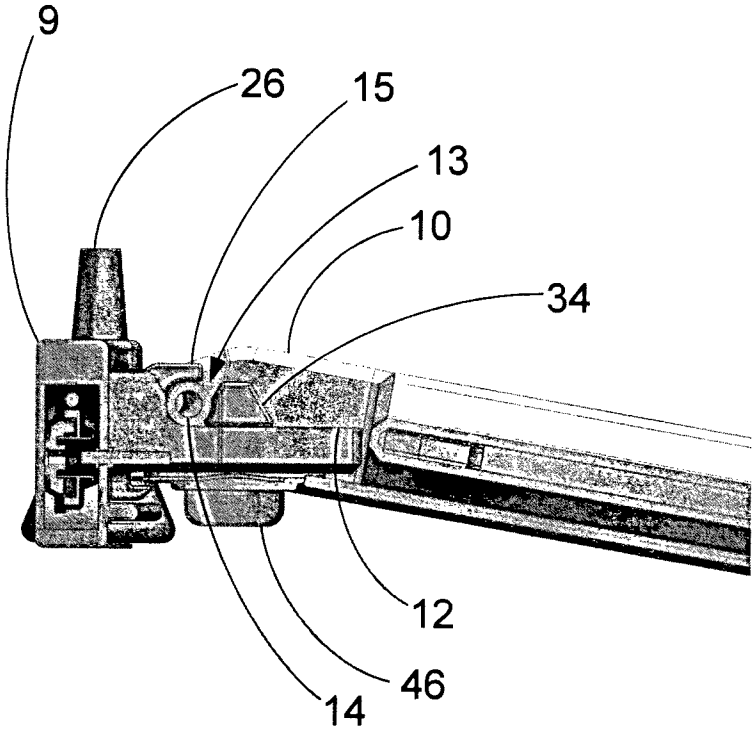
Figure 13A:
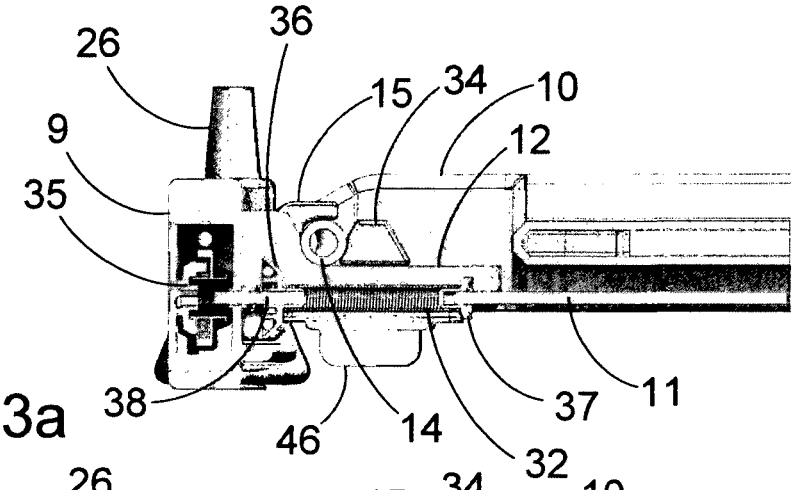
Figure 13B:
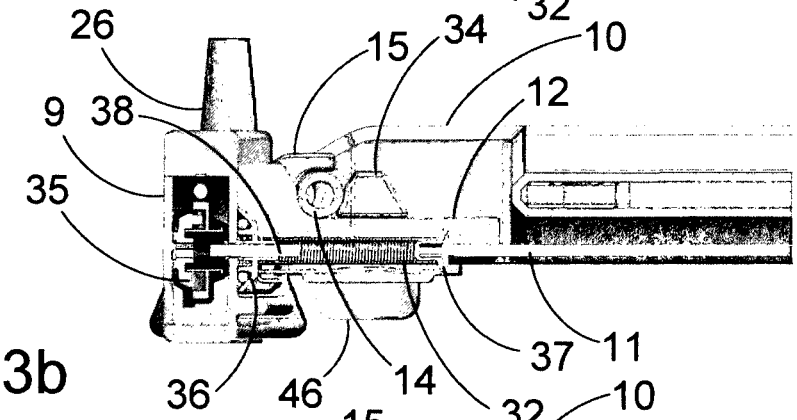
Figure 13C:
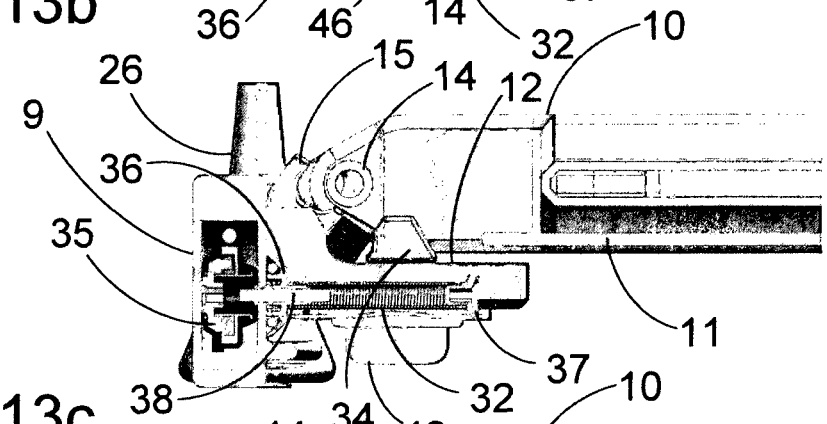
Figure 13D:
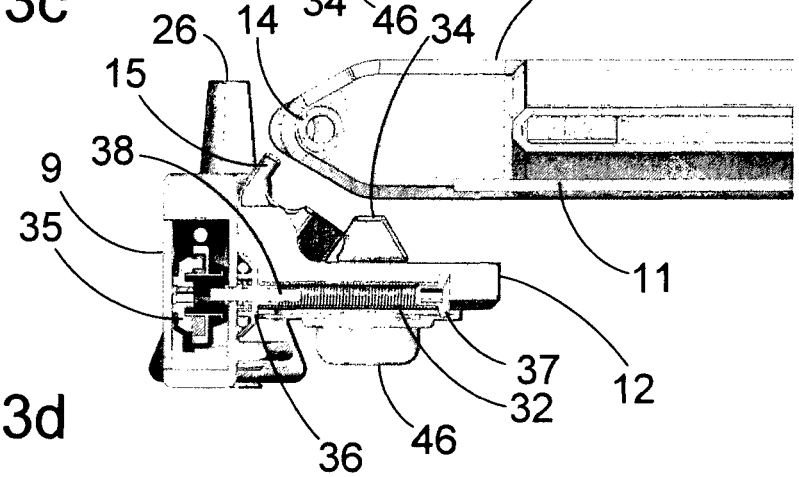
Figure 14:
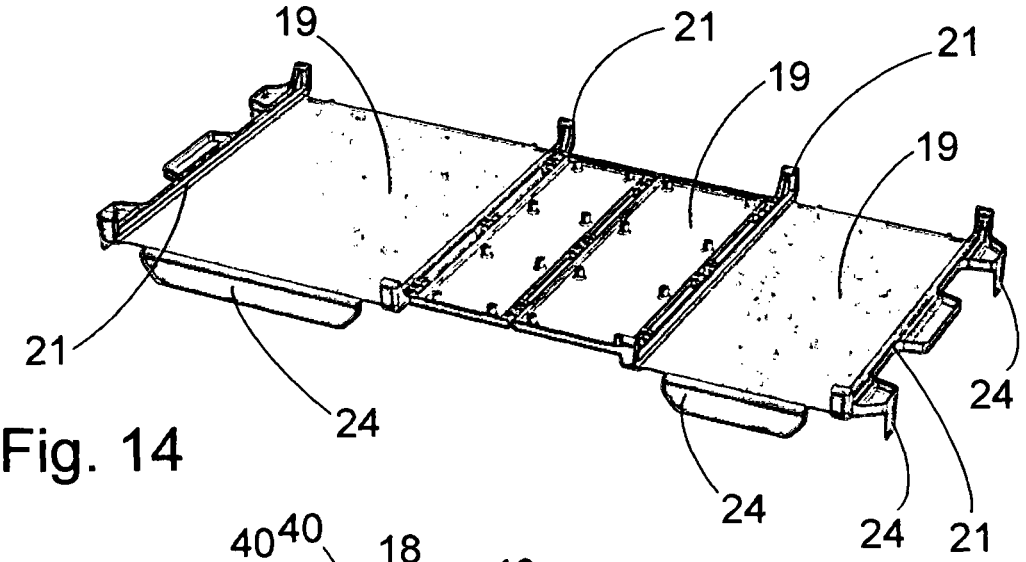
Figure 15:
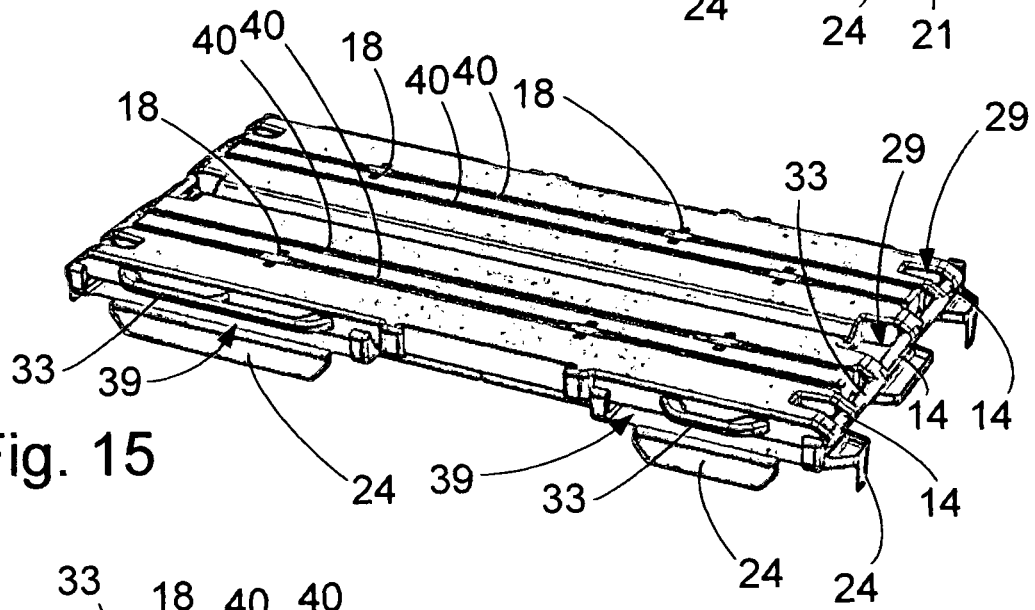
Figure 16:
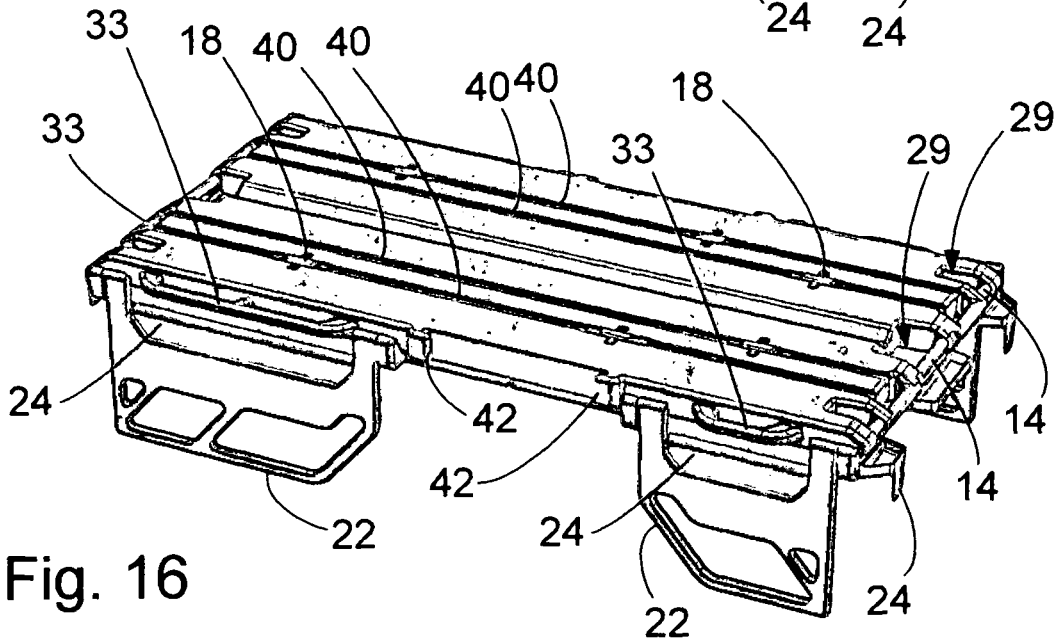

The present invention will now be described in greater detail based on non-limiting exemplary embodiments and with reference to the appended schematic drawings, on which:

FIG. 1 shows an exploded view of a first embodiment of a bed according to the invention, FIGS. 2-5 are various side views of the bed according to the invention showing different inclinations and configurations of the configurable patient support, FIG. 6 shows a perspective view of the bed according to the invention with the releasable means released and the patient support base swung to a vertical position, FIG. 7 shows a number of beds in the position of FIG. 6 and ganged together, FIG. 8 shows the bed in a low inclined position, FIGS. 9*a*-9*f* show the sequence of placing a patient support base on the remainder of the bed with the help of a trolley, FIG. 10 shows an exploded view of a second embodiment of a bed according to the invention, FIG. 11 shows an elongated operator housing according to the invention as implemented in second embodiment of the bed shown in FIG. 10, FIGS. 12*a* and 12*b* show the two ends of an inclined patient support base held in a respective, elongated operator housing according to the embodiment shown in FIG. 11, FIGS. 13*a* to 13*d* show various stages in the release and removal of the patient support from the elongated operator housing according to the embodiment shown in FIG. 11, FIG. 14 is a perspective bottom view of the configurable patient support, FIG. 15 is a perspective bottom view of patient support part mounted below the configurable patient support of FIG. 14, FIG. 16 is a perspective bottom view of the patient support part and the configurable patient support of FIG. 15 but furthermore with cot sides extracted and mounted.

In the following description, when used in relation to the bed, terms indicating direction or position, such as upper, lower, above, below, vertical and horizontal, etc. are to be understood as referring to a bed in a normal position of use, i.e. resting on a plane horizontal surface such as a floor. Likewise terms like along, across, longitudinal are used in their normal sense in relation to a bed. For items identical in the different embodiments or corresponding to each other the same reference numerals are used.

Turning first to the exploded view of in FIG. 1 the various parts of the bed 1 are shown. The base part of the bed comprises a hollow longitudinal beam 2. The longitudinal beam 2 may be made of steel, extruded aluminium or any suitable material. As will be explained later, the longitudinal beam 2 may be extendable, e.g. in a telescopic manner. The longitudinal beam 2 is terminated at either end by generally X-shaped end members 3 forming opposite ends of the base part. The end members 3 are preferably made of pressure cast aluminium or reinforced plastic materials. Each of the X-shaped end members 3 are supported on a pair of wheels 4, arranged under the ends of a respective pair of arms of the X-shaped members in a manner per se known. Consequently, the base part, and hence the bed 1, may readily be moved around from one place to another. The wheels 4 are preferably swivel wheels to increase maneuverability of the bed 1, when moving it. Furthermore, the wheels 4 are preferably of a large diameter such as between 15 cm and 25 cm, so as to reduce the stress and wear on floors and other surfaces, when the bed 1 is moved around with the weight of a patient. The dimension of the wheels 4, however, is a trade-off between the desire to achieve low minimum elevation of the bed 1, and reducing wear on the floors and other surfaces. The wear on the surface is, furthermore, reduced because of a systematic use of light materials such as plastic and aluminium in the bed 1, which reduces the overall weight of the bed 1 to about 50% of a conventional hospital bed 1 of welded steel. Preferably, the wheels 4 comprise built-in locking means for locking the wheels 4 in a predetermined direction, e.g. aligned with the longitudinal direction of the bed 1. The built-in locking means is preferably wirelessly remote controlled, so as to lock the wheels 4 individually or preferably in pairs. Locking can be both locking of swivel motion of the wheels 4 and locking of the wheel rotation, i.e. braking the wheels 4. Using such built-in wireless remote control is advantageous over mechanical couplings necessary for locking the wheels 4 in pairs, in terms of work procedures, ergonomics and time consumption. Locking the swivel motion of a pair of the wheels 4 is in itself advantageous when transporting the bed 1, and doing so only requires the push of a button. Likewise does locking the rotary motion of the wheels 4 in situations where the bed 1 must be stationary or vice versa. This locking may even be performed automatically so that if the bed 1 is not moved the bed 1 is prevented from inadvertently running. The release of the locking of the wheels 4 could then be performed by the single push of a button, when the bed 1 has to be moved. Furthermore, the wheels 4 may be of a type automatically locking themselves upon power failure.

The ends of the other pair of arms of each X-shaped member 3 are generally arranged lower than the ends of the pair of arms resting on the wheels 4 in order to ensure a low height of the base part. On each of these ends of the other pair of arms a telescopic elevator column 5 is arranged. The bed 1 thus comprises a pair of telescopic elevator columns 5 arranged at both ends of the bed 1.

As betters seen in FIGS. 4-8, each telescopic elevator column 5 comprises a number of tubes 5*a*, 5*b* and 5*c*. These tubes 5*a*, 5*b* and 5*c* are preferably made of cold drawn steel or extruded aluminium, but other suitable materials and manufacturing processes such as laser welded steel tubes 5*a*, 5*b* and 5*c* may be used. In the preferred embodiment there are three tubes, an outer tube 5*a*, an inner tube 5*c* and an intermediate tube 5*b*. The outer tube 5*a* is closed at the upper end but open at the lower first end so as to allow the intermediate tube 5*b* and the inner tube 5*c* to perform a sliding motion through the first open end from a retracted position at least partially within said outer elongate tubular member 5*a* to an extended position at least partially outside said outer elongate tubular member 5*a*.

The inner tube 5*c* is, at a first end, mounted perpendicularly to an arm of the X-shaped end members 3 of the base part, i.e. so that the telescopic elevator column 5 is vertical. Having the inner tube 5*c* of the telescopic elevator column 5 attached to the X-shaped member 3 of the base part, and as will be explained below the patient support part connected at the bottom of the outer tube, i.e. in the vicinity of the open end thereof, has the advantages that any gaps between the outer tube, the intermediate tube and the inner tube face downward. Therefore, the outer tube 5*a*, being closed upwardly and having a larger diameter, will protect the inner ones against liquids running down and gather under the influence of gravitation, and consequently water, cleaning and disinfection agents, as well as dirt are less prone to enter. This is in particularly relevant for unauthorized liquids, e.g. spills or incorrect cleaning. It will, however, also be the case even when during correct cleaning the telescopic elevator columns 5 are fully extended in order to clean the inner tubes 5*b*, 5*c*.

At the lower end of each of the outer elongate tubular members 5*a* a bracket 6 is mounted. The brackets 6 are preferably mounted on the elongate tubular member 5*a* by welding. However, welding is largely avoided in the overall construction of the bed 1, and preferably these welds are the only ones in the entire construction. At least one of the brackets 6 in each pair of brackets 6 at either end of the bed 1 comprises a long hole 7. The brackets 6 carry a cross-beam 8 extending between the respective telescopic elevator columns 5 of each pair at either end of the bed 1. The long hole 7 allows compensation of the change in the distance between the brackets 6 when the brackets 6 are not elevated to the same height. Preferably the cross-beam 8 may be locked with respect to the long hole 7, in order to reduce stress at the other bracket 6 in an inclined position of the cross-beam 8.

The telescopic elevator columns 5 are preferably driven in accordance with the applicant's earlier patent application EP-A-1286909, incorporated herein by reference. The electric lifting motors, which, as will be explained later, may be individually controlled to raise the telescopic elevator columns 5, are preferably controlled using the position sensing and control disclosed in the applicant's earlier patent application EP-A-1929623, incorporated herein by reference.

As mentioned above the longitudinal beam 2 may be extendable, e.g. in a telescopic manner comprising two tubes. Preferably, the dimensions of the longitudinal beam 2 is in that case chosen so that one or two of the tubes may be made from the same extruded tube profile used for the tubes 5*a*, 5*b*, 5*c* of the telescopic the elevator column 5. If the longitudinal beam 2 is not telescopic but comprises only a single tube this tube would also preferably also be made from the same extruded tube profile used for the tubes 5*a*, 5*b*, 5*c* of the telescopic the elevator column 5. In either case the number of necessary parts can be reduced since tubes for different purposes may be cut from the same stock profile. The tubular beam 2 is preferably joined to the X-shaped members 3 in accordance with the applicant's patent application EP-A-1404980 incorporated herein by reference.

An operator housing 9 is mounted on the cross-beam 8 so as to be supported thereby. As will be explained later, the operator housing 9 is in a releasable engagement with the cross-beam 8, allowing, when engaged, the operator housing 9 to follow the up, down and tilting movements of the cross-beam 8, and allowing, when released, the operator housing 9 to be swung to a vertical or essentially vertical position. For storage purposes an entirely vertical position is preferred, whereas for cleaning purposes the position should not be entirely vertical, but slightly inclined in order to avoid, in turn, horizontal side surfaces, where water and other cleaning agents could gather. Avoiding horizontal surfaces will allow the water and other cleaning agents to run off.

The bed 1 further comprises a patient support base 10. The patient support base 10 is at either end attached to the respective operator housing 9 in a preferably releasable, removable and interchangeable manner, as will be explained below in connection with FIGS. 13*a*-13*d*.

The patient support base 10 is preferably a one-piece, injection moulded part of plastic material, but depending on use it may be advantageous to join it from two halves so as to have a sealed cavity in which transmission shafts and rods 11 may be located, and so as to hide away any rein-forcing ribs, where dirt and the like could build up. The transmission shafts and rods 11 could of course also be located in open longitudinal grooves, preferably below the patient support base 10, in particular if the patient support base 10 is made as the one-piece injection moulded part mentioned above. The patient support base 10 preferably comprises carrier handles 33 at the sides and ends so as to allow manual lifting, carrying and handling.

As can best be seen on the left-hand side of FIG. 1 and in FIG. 11, the operator housing 9 comprises a number of cantilevers 12, each with a recessed cut-out 13. In the embodiment of FIG. 1 the recessed cut-outs 13 are formed integrally in the cantilevers, whereas in the embodiment of FIG. 10 they are provided by means of additional members 34 mounted in a suitable manner on the cantilevers 12. The recessed cut-outs 13 are adapted to receive short shafts 14 formed in a corresponding number of slots 29 at both ends of the patient support base 10. Depending on whether sliding motion of the short shafts 14 in the recessed cut-outs 13 is desired or not, different, also somewhat jaw-like, securing means may in the embodiment of FIG. 1 be used to close the recess. In this respect, the securing means 15 are formed with semicircular recesses 17 corresponding to the diameter of the short shafts 14, so as to form a journal bearing, in which the patient support base may perform pivotal motion with respect to the operator housing 9. If sliding motion is desired, the securing means 15 used to close the recess, the securing means 15 would instead have an elongate recess, possibly even being open at one end so as to form a fork-shape together with the cantilever 12. The securing means 15 at both ends are, as mentioned, detachable from the operator housing 9 and the cantilevers 12, so as to allow the removal of the patient support base 10.

In the embodiment of FIG. 10 the securing means 15 is a hook cooperating with the additional members 34. As best seen by comparison between FIGS. 12*a* and 12*b* the additional members may take different forms, depending on whether they should allow sliding motion of the patient support base 10 or not.

In both embodiments, the shapes of the securing means 15 and the position of the recesses 13, 17 are adapted to ensure that in a horizontal position of the patient support base 10 the short shafts 14 have no play. That is to say, no reciprocating movement of the patient support base 10 between the operator housings 9 is possible. This further protects the operator housings 9 against possible impact on walls, doors and other obstacles, as mentioned above, because forces will be transmitted to the patient support base 10 and to the other operator housing 9, thus helping in absorbing any impact. The securing means 15, be it the jaw-like securing means 15 of the first embodiment, or the hook-shaped securing means 15 of the second embodiment, they are preferably hinged to the operator housing 9. In either case they are also preferably also spring biased towards an open position, so as to automatically open when not secured in the closed position where they close the recess. That is to say upon release they automatically open and do not obstruct the removal of the short shafts 14 and thus the entire patient support base 10.

As can be seen in the exploded view of FIG. 10, the elongate operator housing contains a number of electric motors 35 for the operation of the position configuring parts 19. These motors 35 are accommodated in suitable accommodations 20 (best seen in FIG. 7), such as pockets forming part of the elongate operator housing 9, where they are well protected from contaminants, water, cleaning agents, corrosive substances etc.

The patient support base supports a number of actuators 18 to which the position configuring parts 19 may be connected. As mentioned, the actuator motors for such actuators 18 are electric actuator motors 35 located in the operator housing 9, e.g. in suitable actuator motor accommodations 20 formed in the operator housing 9 so as to have all motors, except the lifting motors for driving the telescopic elevator columns 5, located together at either end. The transmission to the actuators will then be using suitable shafts 11, cranks-shafts, cardans, splines, coil springs 32 or the like to take up differences and angles when the patient support base 10 moves with respect to the operator housing 9, i.e. in the cantilevers 13 and securing means 15, 16 as explained above. Preferably, the shafts 11 comprise a polygonal cross-section allowing them to be coupled to the electric actuator motors in the actuator motor accommodations 20 within the operator housing 9 via suitable transmission means 32.

As can be seen from FIG. 11 such transmission means 32 may comprise coil springs with suitable bushings 36, 37. The bushings 36, 37 preferably have a hexagonal hole in order to engage and cooperate with the transmission shafts 11 for the configurable parts 19 and further short operator housing output shafts 38 engaging the electric motors 35. These transmission shafts 11 and operator housing output shafts 38 evidently having suitable, preferably also hexagonal cross-sections, in order to engage the respective bushings 36, 37. Evidently other suitable matching cross-sections such as square-cross sections may be used instead. The bushings 36 closest to the operator housing are preferably adapted to aid in the sealing of necessary openings of the housing.

The bushings 36, 37 are preferably adapted to slide with respect to the transmission shafts 11. There are two reasons for this. One reason being to compensate for differences. In particular to take up differences in the distance between the patient support base 10 and the operator housings 9, which varies with the longitudinal inclination of the patient support base 10. The other reason being to easily disengage the transmission shafts 11 from the actuator motors 35, so as to allow removal of the patient support base 10 from the bed 1. Thus all it takes to remove the patient support base 10 from the bed 1 is to disengage the securing means 15, 16 from their locked position, slide the bushings out of engagement of the shafts 11, and lift the patient support base 10 away.

The sliding motion of the bushings 36, 37 is effected by moving an operation bar 46 back and forth along the operator housing 9 as indicated by the double arrow in FIG. 11. By sliding the operation bar 46 back and forth suitable cam surfaces 47, 48 engage and move the bushings 36. Likewise a similar cam surface engages and moves the securing means 15 in a manner coordinated with the bushings 36.

Furthermore by using the coil spring 32 between the bushings 36 and bushing 37 the link between the operator housing output shafts 38 and the transmission shafts 11 becomes bendable and may accommodate for different inclinations of the patient support. Alternatively, a cardan shaft could be used but the bendable link using a coil spring 32 with bushings 36, 37 is currently preferred.

Since this drive for the actuators 18 is also electric, these actuator motors 35 and thus the positions of the individual position configuring parts 19 may also be controlled by the patient himself sitting on the bed by the use of a control panel on the bed 1, or by using a cabled or wireless remote control, preferably the same as used for the lateral inclination (tilt) of the patient support base 10 as described. To the extent possible, any electronics and wiring associated with the actuator motors for the actuators 18 as well as electronics and wiring associated with various sensors, alarms etc. for patient monitoring are also preferably located within the operator housings 9, where they are well protected against external influences such as aggressive cleaning agents, disinfectants, mechanical impacts etc. If it is not possible, e.g. due to retrofitting, to fit all of the electronics and wiring associated with the actuator motors for the actuators as well as electronics and wiring associated with various sensors and/or alarms into the operator housing 9 some of it could be fitted in a separate housing connected to the operator housing 9 or preferably to the cross-beam 8, such as located in V-shaped accommodations 44 arranged on the cross-beam 8. Such a separate housing could also include back-up batteries for the overall electrical system, which is preferably laid out for low voltage DC such as 12V or 24 V to avoid any electric shock hazard. In addition to the V-shaped accommodations 44 the cross-beam 8 could also have an accommodation for an arm and gallows arrangement, such as a protrusion 45 with a vertical blind hole for mounting the arm and gallows. Having this protrusion 45 arranged on the cross-beam ensures that the gallows moves with the patient support base and thus stays within reach of the patient.

Electrical connections from the operator housing 9 to the X-shaped end members 3 are preferably drawn as extendable spiral cabling external to the telescopic columns 5 in order to avoid damage to the cabling due to the moving parts within the telescopic columns 5.

Figure 3:
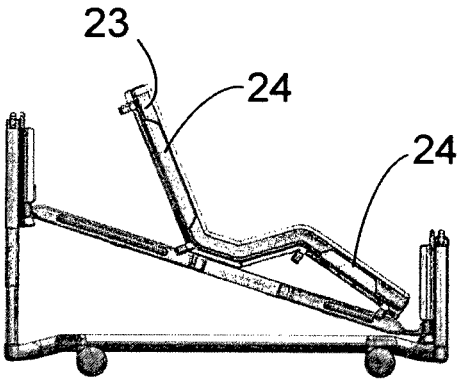

Turning now to FIGS. 14-16 where the patient support base 10 and the position configuring parts 19 are shown in greater detail, it can be seen that between the position configuring parts 19 and the patient support base 10 a number of spacer brackets 21 are located. These spacer brackets 21 support the position configuring parts 19 in their flat, flush position, i.e. as shown in FIGS. 4 and 5. As can best be seen in FIG. 15, the spacer brackets 21 also provide storage spaces 39 for cot sides 22, when the cot sides 22 are not in use. As can be seen in FIG. 16, the cot sides 22 are smooth and rounded in order not to allow dirt to gather. Though not shown in any of FIGS. 1, 9, and 14-16, the bed 1 is of course in normal use fitted with a removable mattress 23 for patient comfort, as e.g. seen in FIGS. 2-4. The position configuring parts 19 preferably comprise low bent-up side parts 24. These serve dual purposes. The first purpose is preventing lateral or longitudinal motion of the removable mattress 23. The second purpose is to support and lock the cot sides 22 when these have been extracted from the accommodations 39 and mounted in the upright position as shown in FIG. 16.

As can be seen from FIGS. 15 and 16 the underside of the patient support base 10 is provided with longitudinal grooves 40 accommodating the actuators 18 by which the position configuring parts 19 may be moved between configurations. When the patient support base 10 is properly fitted on a frame, the transmission shafts 11 also run along these grooves 40 from the operator housing 9 to the actuators 18. It can also be seen that the patient support base has undercut protrusions 42 allowing for the fitting of additional cot sides 22'. Though pertaining to the embodiment of FIG. 1 it can be seen from FIG. 8 that the additional cot sides 22' are preferably constructed so that they overlap the other cot sides 22 on the outside of the bed 1. They thus support the other cot sides 22 and increase safety against the patient falling out of the bed 1. The skilled person will understand that this like most other features disclosed may be fully interchangeable between the various embodiments of the bed 1 according to the invention.

Turning now to FIG. 11 in conjunction with e.g. FIG. 10, it can be seen that the operator housing 9 is preferably also adapted for receiving and holding removable end board members 25, e.g. by the end boards 25 comprising suitable receptacles, such as cylindrical or frusto-conical holes, and the operator housing 9 comprising complementary tubular, cylindrical, frusto-conical or otherwise suitably adapted protrusions 26.

Furthermore, handles 31, such as handle bars or knobs may conveniently be fitted on the upper ends of the outer tubes 5*a* of some or each of the telescopic lifting mechanisms 5, allowing good grip when moving the bed 1 around e.g. by pulling or pushing. Moreover, as can be seen from FIG. 10 the knobs 31 may comprise vertical cut-outs 42. These cut-outs 42 are arranged vertically above vertical blind holes 43 at the ends of the X-shaped members 3. The cut-outs 42 aid in supporting poles (not shown), such as intravenous poles, which may be fitted in the blind holes 43.

As will be realized by comparison between FIG. 6 and FIG. 8 the bed 1 according to the invention incorporates two independent ways of tilting the patient support base 10.

In principle, as soon as the elevator columns 5 have lifted the mounting brackets 6, and consequently also the cross-beam 8 and the operator housing 9 and the patient support base 10 sufficiently high above the longitudinal beam 2 of the base part, full rotational motion of the patient support base 10 about a longitudinal axis between the mounting brackets, could be allowed. However, for practical purposes it suffices to pivot the patient support base 10 to a fully vertical position as shown in FIG. 6 and FIG. 7. This first possibility relies on manual operation. After release of a suitable locking mechanism 41, preferably child proof and involving two handed operation, the pivoting means is released to pivot the operator housing 9 about an axis, shaft or pin 28 on the cross-beam 8. This allows the patient support base 10 to be swung into the illustrated vertical space saving position. Such pivoting means may be devised in various different ways, and instructed to find one the skilled person will have no problems in doing so.

In this fully vertical position the patient support base 10 occupies the space approximately above the longitudinal beam 2 in the imaginary plane in which the longitudinal beam 2 lies. As can be seen from FIG. 7 this allows beds 1 to be ganged closely together for storage, cleaning, disinfecting, sterilizing in an autoclave, etc. restricted only by the width of the cross-arms of the X-shaped members 3. If the height of the cot sides 22 and end boards 25 is suitably dimensioned, storage and sterilization, but in particular cleaning and disinfecting, may be performed with the end boards 25 in place and the cot sides 22 raised from the storage position on or within the bed 1 to an accessible position, i.e. the essentially horizontal position of the cot sides 22 shown in FIG. 6. As mentioned earlier, for cleaning a not entirely vertical position is desirable in order not to present any entirely horizontal surfaces, e.g. on the cot sides 22 during cleaning, so as to prevent water and other cleaning agents from gathering. In this fully as well as in the essentially vertical position the beds 1 according to the invention take up substantially less space than conventional beds. Four beds 1 according to the invention will take up about the same space as two conventional hospital beds, thus reducing the need for space with about 40%. Thus, more beds 1 will fit into the autoclave at the same time, more beds 1 will fit into a designated storage space, and more beds 1 will fit into the hold of a lorry during external transportation.

In the embodiments shown, four telescopic elevator columns 5 with three tubes 5*a*, 5*b* and 5*c* are used. This suffices for allowing the patient support base 10 to be elevated to a maximum of approximately 90-100 cm, as illustrated in FIG. 5. This height not only suffices for allowing the patient support base 10 to be tilted to the vertical storage position, but also allows the elevation of the horizontal patient support base 10 to a height which is ergonomically favorable for the care personnel, which then need not bend down to the patient.

The second tilting possibility relies on electric motors (not shown) located in a protected manner within or below the elevator columns 5. For tilting motion electric motors independently drive the elevator columns 5 to desired heights. Provided that the pivoting means is securely locked in a safe position, so that operator housing 9 is fixed with respect to the cross-beam 8, this allows motor-controlled tilting of the cross-beam 8 and hence the patient support base 10. As will be understood, independently controlling the elevator columns also allows for changes in the overall inclination of the bed 1. As will be explained below, the motor-controlled elevator columns 5 may be remote and/or computer controlled. The tilting motion is preferably limited to an angle of e.g. 25 to 30 degrees with respect to horizontal, in order to prevent the patient or other operators from inadvertently achieving angles, which may cause the patient to roll or slide off the bed 1, if cot sides 22 are not mounted. This, as shown in FIG. 8, allows the patient support base 10 to be inclined slightly in the lateral direction, so as to aid the patient in getting in or out of the bed 1, provided of course that the cot sides 22 are removed. Since the drive is electric this may be controlled by the patient himself sitting on the bed by the use of a control panel (not shown) on the bed 1, or by using a cabled or wireless remote control. The tilting motion may, furthermore, be computer controlled, e.g. for automatically providing varying small lateral tilting angles, possibly combined with a longitudinal inclination of 12° or more, which will reduce the risk of bed sores as well as urine and lung infections for a bedridden patient.

As explained above, having the support brackets 6 mounted at the lower ends of the outer tubes 5*a* of the elevator columns 5, allows the support brackets 6 and consequently the patient support base 10 to be lowered to a very low minimum height, essentially all the way down to the longitudinal beam 2 of the base part. This as mentioned before reduces the risk of injury if a sleeping, sedated or drugged patient falls out of the bed 1. As can be seen from FIG. 3, FIG. 4 and FIG. 8 the elevator columns 5 are individually controllable independently of each other. Thus, the patient support base 10 may be lowered at one end and raised at the other, so as to add an additional degree of freedom to the various positions obtainable by the position configuring parts 19, as can be seen by comparison between FIG. 2 and FIG. 3. However, with the patient support base 10 in a longitudinally inclined position as shown in FIG. 3 and the Trendelenburg position shown in FIG. 4, the distance between the operator housings 9 is longer than in the situation in e.g. FIG. 5, where the patient support base 10 is horizontal. Thus, at least one of the operator housings 9 is adapted to allow displacement and turning of the patient support base 10 with respect to the cross-beam 8, which, in turn, is mounted on the mounting brackets 6 on the outer tubes 5*a* of the respective pair of telescopic elevator columns 5. Preferably this is as explained above achieved by shaping, at the operator housing 9 at one of the ends of the bed 1, the upper part of the securing mechanism to allow sliding motion of the short shafts 14 of the patient support base 10 in the recesses 13 of the lower cantilever parts 12, e.g. as shown in 12*b*.

Similarly, with the patient support base 10 in a tilted or sideways inclined position as shown in FIG. 8, the distance between the brackets 6 is longer than in the situation in e.g. FIG. 5, where the patient support base 10 is horizontal. To compensate for this at least one of the brackets 6 at either end of the bed 1 has a long hole 7 allowing displacement of one end of the cross-beam 8. The long holes 7 are preferably at the same side of the bed. Furthermore means may be provided to lock the long holes 7 with respect to the bracket 6 so as to reduce stress on the corresponding bracket 6 of the opposite side of the bed 1, which in an inclined position of the cross-beam 8 would carry more sideways stress and load. In particular if a patient is in the bed 1. Apart from these minor deviations, the telescopic elevator columns 5, the cross-beams 8, the operator housings 9, the brackets 6, etc. are preferably identical at either end of the bed 1, so as to reduce the number of necessary different parts to be manufactured and stored in the production of the bed 1.

As can be understood from the above, providing the operator housing 9 as a pivotable unit, not only allows the patient support base 10 to be easily swung to the vertical space saving storage position, but also allows easy removal of the patient support base 10 from the bed. All that has to be done is releasing the securing means 15 from the cantilevers 12, release the simple mechanical couplings 32, 36, 37 between the operator housing output shafts 38 and the shafts 11, upon which the patient support part 10 may be removed. No electrical connections need be severed as the patient support part 10 is quite a simple construction, comprising only mechanical components. The details of this are shown in FIGS. 13*a*-13*d*.

Turning first to FIG. 13*a* it can be seen that the short shaft 14 of the patient support part is resting on the cantilever 12 of the operator housing 9. The hook shaped securing means 15 is in a closed position holding the short shaft 14 of the patient support part 10 relatively firmly engaged against the additional member 34 allowing, however, the necessary rotary movement of the short shaft 14 with respect to the cantilever in order to tilt and incline the patient support base 10. The transmission shafts 11 are engaged in the bushing 37 which is connected to the coil spring 32, in turn, connected to the bushing 36. The short operator housing output shaft 38 is engaged in the bushing 36 thus establishing a complete transmission from the electric motor 35 to the operators 18 (not shown) at the far end of the transmission shafts.

In FIG. 13*b* it can be seen how the coil spring 32 has been pushed to the left by the cam surface 47 of the operation bar 46, as mentioned above in connection with FIG. 11, and consequently the bushing 37 is retracted towards the operator housing 9. The bushing 37 has been retracted so far that the transmission shaft 11 is no longer engaged in the bushing 37.

In FIG. 13*c* the locking mechanism of the hook shaped securing mechanism 15 has been released. As mentioned above the hook shaped securing mechanism 15 is preferably biased towards the open position and therefore no longer holds the short shaft 14 of the patient support base 10 firmly against the additional member 34. Since both the short shaft 14 and the transmission shaft 11 have been disengages from the securing means 15 and the bushing 37, respectively, nothing obstructs the removal of the patient support base 10 and it may be removed entirely from the operating housing 9 and thus the base part of the bed 1, as shown in FIG. 13*d*. Evidently, it may be fitted again, on the same or a corresponding base part by reversing the steps of FIGS. 13*a* to 13*d*.

This easy removal of the patient support base 10 allows the patient support base 10 to be used as a versatile component in transporting the patient. Thus, upon transport of a patient to a treatment or examination station such as a scanner, into an ambulance, etc. without the difficult, cumbersome, and sometimes dangerous process of removing the patient from the patient support.

FIGS. 9*a* to 9*f* illustrate this process, albeit without the patient. FIG. 9*a* illustrates how the patient support is delivered on a trolley 30 to a vacant base part. The elevator columns 5 of the base part are all lowered. Using the trolley 30 the patient support base 10 may easily be placed in a suitable position over the base part, as illustrated in FIG. 9*b*. The elevator columns 5 are then all raised so as to move the operator housings 9 with the cantilevers 12 and securing means 15, 16, into engagement with the short shafts 14 of the patient support as illustrated in FIG. 9*c*. The securing means are then secured and the mechanical coupling between the operator housing 9 and the shafts 11 are engaged. Upon this, the trolley 30 may be removed as illustrated in FIG. 9*d* and FIG. 9*e*, leaving a fully usable assembled bed 1 as illustrated in FIG. 9*f*. For removing the patient support base 10 corresponding steps are performed in the reverse order.

This allows e.g. a patient to be lifted from the bed onto the trolley 30, transported to an ambulance, lifted into the ambulance possibly including the trolley if the trolley is devised for ambulance purposes, transported to another hospital, a care center or home, where another identical base is waiting and onto which the patient support base is then fitted. All of this can be done without removing the patient from the patient support, and thus removes the inconveniences and dangers in getting the patient out of bed in a traditional manner. Moreover, from a logistic perspective this is advantageous, as the base may be transported separately at a convenient time, because it need not follow the patient.

The invention claimed is:

1. A bed, comprising, a base part having a first end and a second end, with a patient support base arranged above the base part and including a position configurable patient support, four telescopic elevator columns mounted on said base part, said four elevator columns being arranged as a first and a second pair of telescopic elevator columns, said first pair of elevator columns being arranged at said first end of said base part and said second pair of elevator columns being arranged at said second end of said base part so as to define a space extending above said base part between said first pair of telescopic elevator columns and said second pair of telescopic elevator columns, and two cross-beams for supporting the patient support base, wherein an operator housing is mounted on at least one of said cross-beams, said operator housing comprising means for configuring said position configurable patient support, said operator housing and said patient support base comprising mutually releasable connection means, and wherein pivotal means are provided for allowing pivotal movement of the operator housing together with the patient support base to a vertical position with respect to said cross-beams.

2. A bed according to claim 1, wherein a first operator housing is connected to a first of said cross-beams and a second operator housing is connected to a second of said cross-beams, and both of said first and second operator housings are arranged in said space extending above the base part between the first pair of telescopic elevator columns and said second pair of telescopic elevator columns.

3. A bed according to claim 1, wherein each telescopic elevator column comprising an elongate outer tubular member, said outer tubular member having an open first end, and an elongate inner member arranged so as to perform a sliding movement through said open first end from a retracted position at least partially within said outer elongate tubular member to an extended position at least partially outside said outer elongate tubular member, said elongate inner member is supported at a first end by said base part.

4. A bed according to claim 1, wherein each of the four elevator columns are individually controllable.

5. A bed, comprising, a base part having a first end and a second end, with a patient support base arranged above the base part and including a position configurable patient support, four telescopic elevator columns mounted on said base part, said four elevator columns being arranged as a first and a second pair of telescopic elevator columns, said first pair of elevator columns being arranged at said first end of said base part and said second pair of elevator columns being arranged at said second end of said base part so as to define a space extending above said base part between said first pair of telescopic elevator columns and said second pair of telescopic elevator columns, and two cross-beams for supporting the patient support base, wherein an operator housing is mounted on at least one of said cross-beams, and wherein pivotal means are provided for allowing pivotal movement of the operator housing with respect to said cross-beams, and wherein pivotal means are provided for allowing pivotal movement of the operator housing together with the patient support base to a vertical position with respect to said cross-beams.

6. A bed, comprising, a base part having a first end and a second end, with a patient support base arranged above the base part and including a position configurable patient support, four telescopic elevator columns mounted on said base part, said four elevator columns being arranged as a first and a second pair of telescopic elevator columns, said first pair of elevator columns being arranged at said first end of said base part and said second pair of elevator columns being arranged at said second end of said base part so as to define a space extending above said base part between said first pair of telescopic elevator columns and said second pair of telescopic elevator columns, and two cross-beams for supporting the patient support base, wherein an operator housing is mounted on at least one of said cross-beams, said operator housing comprising means for configuring said position configurable patient support, and wherein each of the four elevator columns are individually controllable, and wherein pivotal means are provided for allowing pivotal movement of the operator housing together with the patient support base to a vertical position with respect to said cross-beams.

* * * * *